US007355332B2

(12) United States Patent
Lee et al.

(10) Patent No.: US 7,355,332 B2
(45) Date of Patent: Apr. 8, 2008

(54) CATHODE RAY TUBE

(75) Inventors: Kue-Hong Lee, Suwon-si (KR); Young-Gon Hong, Suwon-si (KR); Yeoung-Uk Nam, Suwon-si (KR); Chang-Ryon Byon, Suwon-si (KR); Hoo-Deuk Kim, Suwon-si (KR); Ho-Rim Choi, Suwon-si (KR); Seok-Nam Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 401 days.

(21) Appl. No.: 11/152,981

(22) Filed: Jun. 14, 2005

(65) Prior Publication Data

US 2006/0119246 A1 Jun. 8, 2006

(30) Foreign Application Priority Data

Dec. 3, 2004 (KR) ..... 10-2004-0101137

(51) Int. Cl.

| | |
|---|---|
| ***H01J 29/86*** | (2006.01) |
| ***H01J 29/92*** | (2006.01) |
| ***H01J 5/24*** | (2006.01) |
| ***H01J 29/87*** | (2006.01) |

(52) U.S. Cl. ..... 313/477 R; 220/2.1 A

(58) Field of Classification Search ..... 313/477 R; 220/2.1 A

See application file for complete search history.

(56) References Cited

U.S. PATENT DOCUMENTS 6,166,484 A 12/2000 Okuyama et al.
6,307,313 B1 * 10/2001 Fukuda ..... 313/421
6,657,374 B1 * 12/2003 Nagasawa et al. ..... 313/477 R
6,680,566 B2 * 1/2004 Hergott et al. ..... 313/477 R
6,885,143 B2 * 4/2005 Kim ..... 313/477 R (Continued)

FOREIGN PATENT DOCUMENTS

EP 0 949 649 A2 10/1999

(Continued)

OTHER PUBLICATIONS

European Search Report, dated Nov. 29, 2005, for Application No. 05104921, in the name of Samsung SDI Co., Ltd.

(Continued)

*Primary Examiner*—Peter Macchiarolo
(74) *Attorney, Agent, or Firm*—Christie, Parker & Hale, LLP

(57) ABSTRACT

An image display device includes a cathode ray tube. The cathode ray tube includes a panel with an inner phosphor screen, and a funnel connected to the panel with a cone portion mounting a deflection unit on the outer circumference thereof. A neck is connected to the funnel while mounting an electron gun therein. The interface between the cone portion and the neck is called a neck seal line, and the portion of the electron gun sealed to the neck called a gun sealing portion. When the distance between the panel and the neck seal line is indicated by A and the distance between the neck seal line and the gun sealing portion by B, the values of A and B satisfy the following conditions:

$0.31<B/A<0.38$ and $79\ \text{mm}<B<95\ \text{mm}$.

20 Claims, 5 Drawing Sheets

U.S. PATENT DOCUMENTS

| | | | | |
|---|---|---|---|---|
| 7,109,647 | B2 * | 9/2006 | Jung | 313/477 R |
| 2002/0153823 | A1 * | 10/2002 | Hergott et al. | 313/477 R |
| 2003/0168963 | A1 * | 9/2003 | Baek | 313/477 R |
| 2004/0222731 | A1 * | 11/2004 | Cho et al. | 313/477 R |
| 2005/0067940 | A1 * | 3/2005 | Jung | 313/477 R |

FOREIGN PATENT DOCUMENTS

| | | |
|---|---|---|
| KR | 2003-0072932 | 9/2003 |
| WO | WO 2004/059688 A1 | 7/2004 |

OTHER PUBLICATIONS

Korean Patent Abstracts for KR 1020030072932 A published Sep. 19, 2003 in the name of Do Hyeong Kim, 1pg.

* cited by examiner

CATHODE RAY TUBE

CROSS-REFERENCE TO RELATED APPLICATION

This application claims the benefit of and priority to Korean Patent Application No. 10-2004-0101137, filed on Dec. 3, 2004 in the Korean Intellectual Property Office, the entire disclosure of which is incorporated herein by reference.

FIELD OF THE INVENTION

The present invention relates to a cathode ray tube, and in particular, to a cathode ray tube which has a shortened electric field length.

BACKGROUND OF THE INVENTION

Generally, a cathode ray tube is a vacuum electron tube in which electron beams emitted from an electron gun are horizontally and vertically deflected to a phosphor screen, thereby emitting light from phosphor layers of the phosphor screen resulting in displaying desired images. The deflection of the electron beams is performed by a deflection unit, which is mounted around the outer circumference of a funnel (the outer circumference of a cone portion substantially forming the vacuum tube) and forms horizontal and vertical magnetic fields.

The cathode ray tube has been mainly used in producing color televisions and computer monitors, and recently has been used in high-end products such as high definition televisions (HDTVs).

However, recently developed flat panel displays, such as plasma display panels, liquid crystal displays, and organic field emission displays, have been spotlighted as the choice of consumers over displays using the cathode ray tube which have excellent display quality but have a large volume vacuum tube (that is, they occupy a large space and are heavy).

In this connection, the cathode ray tube industry has undertaken efforts in reducing the weight of the vacuum tube as much as possible, while maintaining reasonable vacuum-proof strength thereof, as well as shortening the electric field length, thereby slimming the cathode ray tube.

Such efforts appeal to consumers when the image display device using the cathode ray tube as the display unit does not make any significant difference in the space usage compared to flat panel displays.

However, consumers have gradually turned away from image display devices using the cathode ray tube as the display unit because the electric field length of the cathode ray tube cannot be sufficiently reduced due to structural limitations thereof compared to the flat panel displays, even though cathode ray tubes have excellent brightness characteristics and a low production cost.

SUMMARY OF THE INVENTION

In one embodiment, the present invention is a cathode ray tube with a reduced size by reducing the electric field length thereof compared to the screen size. In one embodiment, the present invention is an image display device that includes a cathode ray tube.

The cathode ray tube includes a panel with an inner phosphor screen, and a funnel connected to the panel. The funnel has a cone portion, and a deflection unit is mounted on the outer circumference of the cone portion. A neck is connected to the funnel, and an electron gun is mounted within the neck. The interface between the cone portion and the neck is called a neck seal line (NSL), and the portion of the electron gun sealed to the neck is called a gun sealing portion. When the distance between the panel and the NSL is indicated by A, and the distance between the NSL and the gun sealing portion by B, the ratio of B to A satisfies the following condition:

$$0.31<B/A<0.38,$$

In one embodiment, the values of A and B satisfy the following conditions:

$$253\ \text{mm} \leqq A \leqq 260\ \text{mm},$$

$$79\ \text{mm}<B<95\ \text{mm}.$$

In one embodiment, when the entire length of the cathode ray tube is indicated by C, the value of C satisfies the following condition:

$$350\ \text{mm} \leqq C \leqq 365\ \text{mm}.$$

In one embodiment, when the length of a graphite layer formed at the neck is indicated by D, the value of D satisfies the following condition:

$$10\ \text{mm}<D<23\ \text{mm}.$$

In one embodiment, the value of D may satisfy the following condition:

$$16\ \text{mm}<D<30\ \text{mm}.$$

In one embodiment, the value of D may satisfy the following condition:

$$23\ \text{mm}<D<37\ \text{mm}.$$

In one embodiment, when the length of the electron gun mounted within the neck is indicated by E, the value of E satisfies the following condition:

$$60\ \text{mm} \leqq E \leqq 64\ \text{mm}.$$

In one embodiment, when the length of a shield cup partially placed within the area of the graphite layer is indicated by F, the value of F satisfies the following condition:

$$6\ \text{mm} \leqq F \leqq 10\ \text{mm}.$$

DETAILED DESCRIPTION

Figure 1:
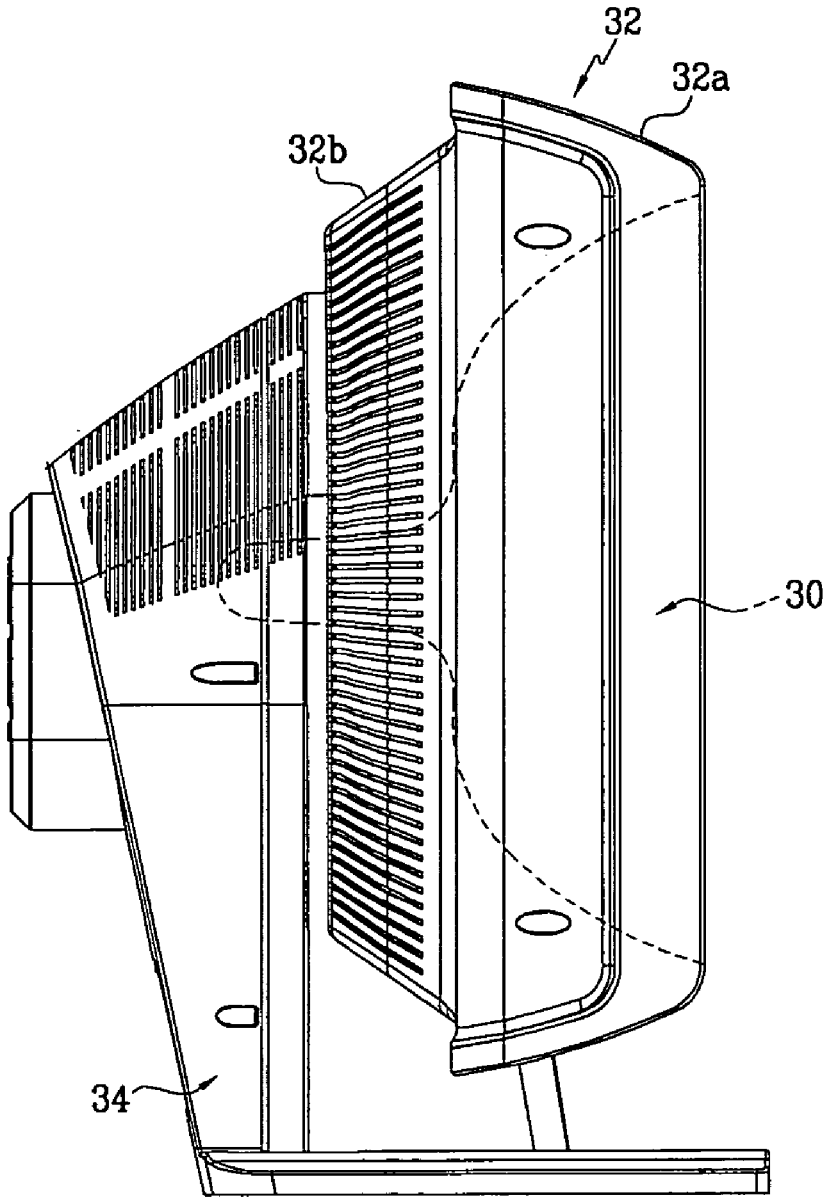
FIG. 1 is a side view of an image display device with a cathode ray tube, according to an embodiment of the present invention.

FIG. 1 is a side view of an image display device including a cathode ray tube according to an embodiment of the present invention.

As shown in the drawing, the image display device includes a cathode ray tube 30 for displaying desired images, a case 32 enclosing the cathode ray tube 30 while forming the outer appearance thereof, and a support 34 connected to the case 32 to support it.

The case 32 includes a front case part 32*a* placed at the front of the cathode ray tube 30, and a back case part 32*b* placed at the rear of the cathode ray tube 30. The front case part 32*a* and the back case part 32*b* are coupled to each other by way of screw coupling. The support 34 is a stand.

The main portion of the cathode ray tube 30 is placed within the case 32, and the neck portion thereof within a cavity in the support 34.

Figure 2:
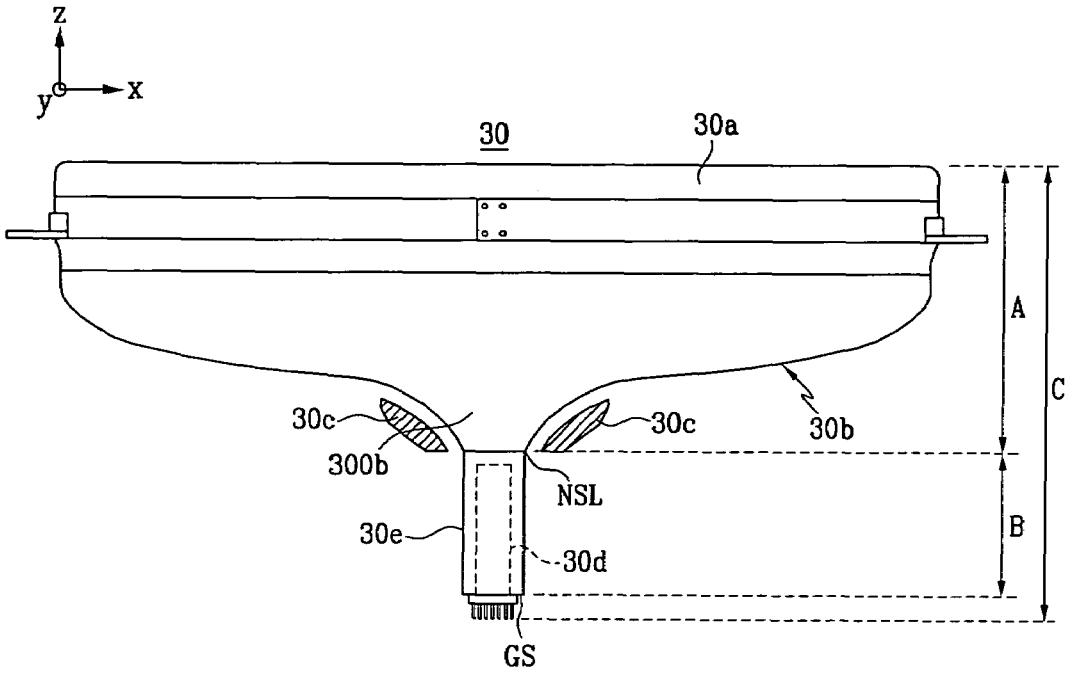
FIG. 2 is a plan view of the cathode ray tube of FIG. 1.
Figure 3:
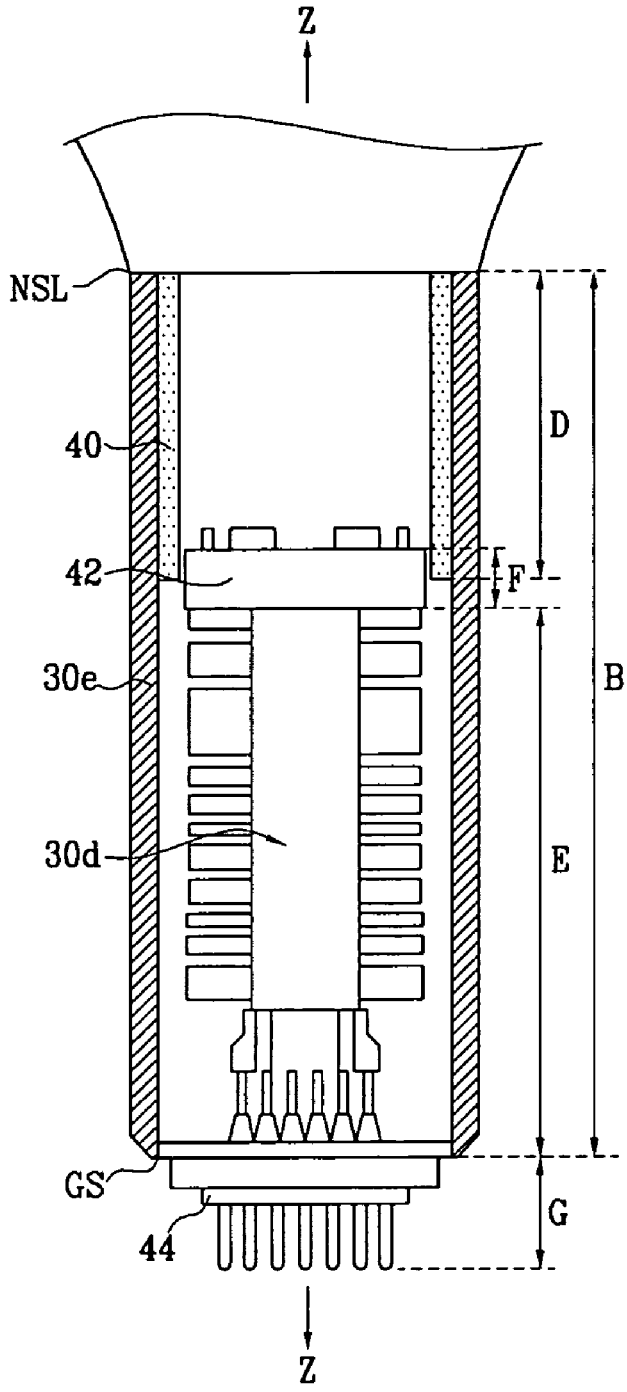
FIG. 3 is a cross-sectional view of a neck for the cathode ray tube of FIG. 1.

FIG. 2 is a plan view of the cathode ray tube 30, and FIG. 3 is a magnified sectional view of the neck portion of the cathode ray tube 30.

As shown in the above drawings, the cathode ray tube 30 is formed with a vacuum tube having a panel 30*a*, which is rectangular-shaped. The cathode ray tube 30 also includes an inner phosphor screen, a funnel 30*b* connected to the panel 30*a* with a deflection unit 30*c* mounted on the outer circumference of a cone portion 300*b* thereof, and a neck 30*e* connected to the rear of the cone portion 300*b* while mounting an electron gun 30*d* therein. The interface between the cone portion 300*b* and the neck 30*e* is called the "neck seal line" (NSL), and the portion of the electron gun 30*d* mounted within the neck 30*e* and sealed to the neck 30*e* is called the "gun sealing" (GS) portion.

With the above-structured cathode ray tube 30, electron beams emitted from the electron gun 30*d* are deflected by the deflection unit 30*c* to the long axis of the panel 30*a* (the horizontal axis of the panel; the x axis of FIG. 2) and to the short axis thereof (the vertical axis of the panel; the y axis of FIG. 2). The deflected electron beams pass through the electron beam passage holes of a color selection unit (not shown) internally fitted to the panel 30*a*, and land on relevant phosphors of the phosphor screen, thereby displaying the desired image.

The cathode ray tube 30 performs the above operation with a shortened entire length and enhanced performance characteristics.

For explanatory convenience, it is assumed that A indicates the distance between the panel 30*a* and the NSL, B the distance between the NSL and the GS portion, C the entire length of the cathode ray tube 30 along the Z axis, D the length of a graphite layer 40 coated on the inner wall of the neck 30*e*, E the length of the electron gun 30*d*, F the length of a shield cup 42 installed at the front end of the electron gun 30*d* and partially placed within the area of the graphite layer 40, and G the distance between the GS and the end of the stem base 44. The lengths of the respective components are measured along the tube axis z of the cathode ray tube 30, and the entire length C of the cathode ray tube refers to the distance between the outer surface of the panel 30*a* and the end of the stem base 44.

The cathode ray tube 30 is structured to satisfy the condition of:

$$0.31<B/A<0.38,$$

where A and B satisfy the following conditions $$253\ \text{mm} \leqq A \leqq 260\ \text{mm, and}$$

$$79\ \text{mm}<B<95\ \text{mm}.$$

With the inventive cathode ray tube, the distance A between the panel 30*a* and the neck seal line (NSL) and the distance B between the neck seal line (NSL) and the gun sealing (GS) portion are optimized. That is, the panel 30*a*, the funnel 30*b*, and the neck 30*e* are optimized in size such that the wide-angled deflection can be made without deteriorating the voltage resistance characteristic or the convergence drift characteristic.

Table 1 illustrates the data of A, B, and C according to Examples (embodiments of the invention) and a Comparative Example (prior art).

TABLE 1

| | Example 1 | Example 2 | Example 3 | Comparative Example |
|---|---|---|---|---|
| A | 253 mm | 253 mm | 253 mm | 260 mm |
| B | 80 mm | 87 mm | 94 mm | 102 mm |
| C | 351 mm | 358 mm | 365 mm | 380 mm |
| Maximum deflection angle | 125° | 125° | 125° | 125° |

The values of A and B satisfy the above conditions such that the entire length C of the cathode ray tube 30 can be shortened, while enabling a wide-angled deflection (e.g., more than 115°) and enhancing the performance characteristics thereof. The performance characteristics of the cathode ray tube may deteriorate when only the length of the neck is simply reduced to shorten the entire length of the cathode ray tube. Although not illustrated in the Examples of Table 1, the inventors of the present invention have discovered that the performance characteristics of the cathode ray tube are well exerted without incurring any problem, when the above conditions are satisfied while keeping the entire length C of the cathode ray tube 30 to be a minimum of 350 mm.

When the value of B is less than 79 mm, the graphite layer 40 may completely cover the shield cup 42 and incur problems in the voltage resistance characteristic. By contrast, when the length of the graphite layer 40 is reduced to prevent such problems, the convergence characteristic is deteriorated. Furthermore, when the length of the electron gun 30*d* is reduced to prevent such a problem, the focusing characteristic of the electron beams is significantly deteriorated.

When the value of B exceeds 95 mm, the length of the neck 30*d* as well as the entire length C of the cathode ray tube 30 are enlarged, and this deviates from the optimum performance of the cathode ray tube 30.

Meanwhile, the voltage resistance characteristic and the convergence drift characteristic of the cathode ray tube are determined depending upon the length D of the graphite layer 40 coated on the inner wall of the neck 30*e*. Therefore, with the cathode ray tube according to the present invention, the length D of the graphite layer 40 is established in the following way.

Tables 2, 3, and 4 list the values of the length D of the graphite layer 40 formed at the cathode ray tubes, according to the Examples 1, 2, and 3. In the above Tables, Eb_ARC indicates the anode voltage value representing the voltage resistance characteristic, and Cg-Drift indicates the distance between the electron beams (e.g., the red and the blue electron beams) representing the convergence characteristic.

In the cathode ray tube industry, it is considered that only when the Eb_ARC exceeds 30 kV and the Cg-Drift is less than 0.6 mm, the relevant cathode ray tube satisfies suitable performance characteristics, without causing any device failure.

TABLE 2

| | D (mm) | | | | | |
|---|---|---|---|---|---|---|
| | 8 | 11 | 14 | 17 | 20 | 23 |
| Eb_ARC (kV) | 33 | 37 | 40 | 40 | 36 | 28 |
| Cg-Drift (mm) | 1.7 | 0.55 | 0.25 | 0.22 | 0.16 | 0.11 |

TABLE 3

| | D (mm) | | | | | |
|---|---|---|---|---|---|---|
| | 15 | 18 | 21 | 24 | 27 | 30 |
| Eb_ARC (kV) | 35 | 38 | 40 | 40 | 37 | 29 |
| Cg-Drift (mm) | 1.45 | 0.5 | 0.25 | 0.21 | 0.15 | 0.12 |

TABLE 4

| | D (mm) | | | | | |
|---|---|---|---|---|---|---|
| | 22 | 25 | 28 | 31 | 34 | 37 |
| Eb_ARC (kV) | 36 | 38 | 40 | 40 | 37 | 28 |
| Cg-Drift (mm) | 1.35 | 0.4 | 0.23 | 0.2 | 0.13 | 0.09 |

Figure 4A:
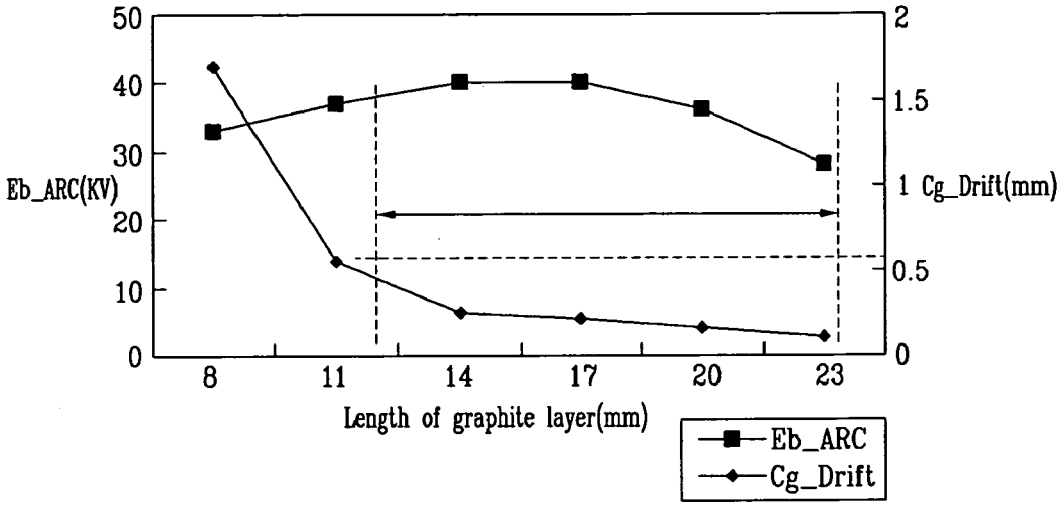
FIGS. 4A to 4C are graphs illustrating the characteristics of a graphite layer for the cathode ray tube, according to one embodiment of the present invention.
Figure 4B:
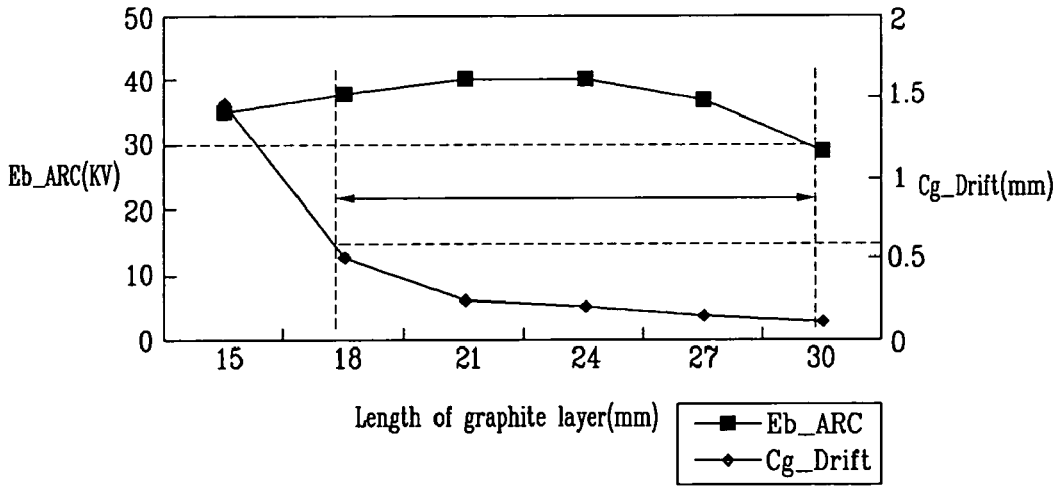
Figure 4C:
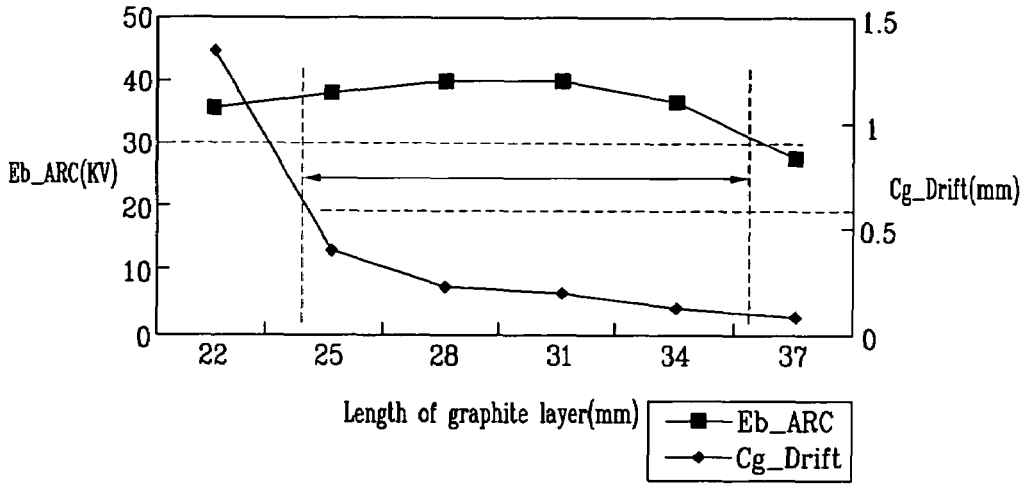

As shown in the above Tables, the performance characteristics of a cathode ray tube (the voltage resistance and convergence drift) can be well obtained when the length D of the graphite layer satisfies the following conditions:

$10\ \text{mm} < D < 23\ \text{mm};$ $16\ \text{mm} < D < 30\ \text{mm};$ and $23\ \text{mm} < D < 37\ \text{mm}.$ FIGS. 4A to 4C graphically illustrate the data listed in the above Tables.

Meanwhile, when the electron gun 30*d* is mounted within the neck 30*e*, the length or location of the shield cup 42 may affect the voltage resistance characteristic of the cathode ray tube 30. In this embodiment, when the shield cup 42 is provided within the neck 30*e*, it is partially placed within the area of the graphite layer 40, and the length F thereof (in the above Examples, the value of F was determined to be 8 mm) satisfies the following condition:

$6\ \text{mm} \leqq F \leqq 10\ \text{mm}.$

In addition, it is preferable that the length E of the electron gun 30*d* and the distance G between the GS and the end of the stem base 44 satisfy the following conditions:

$60\ \text{mm} \leqq E \leqq 64\ \text{mm}$ and $G = 8\ \text{mm}.$

As described above, with the cathode ray tube according to the present invention, the dimensional inter-relation among the respective tube components is enhanced while not deteriorating the device performance characteristics and enabling the wide-angled deflection.

Accordingly, the entire length of the cathode ray tube is shortened, and the slimmed device fulfils the preferences of the consumers.

Although embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A cathode ray tube comprising:

a panel with an inner phosphor screen, a funnel connected to the panel with a cone portion having a deflection unit mounted on an outer circumference thereof, and a neck connected to the funnel having an electron gun mounted therein, wherein when the interface between the cone portion and the neck is called a neck seal line, the portion of the electron gun sealed to the neck is called a gun sealing portion, the distance between an outer surface of the panel and the neck seal line is indicated by A and the distance between the neck seal line and the gun sealing portion by B, A and B satisfy the following conditions:

$0.31 < B/A < 0.38$, and $79\ \text{mm} < B < 95\ \text{mm}.$

2. The cathode ray tube of claim 1, wherein A satisfies the following condition:

$253\ \text{mm} \leqq A \leqq 260\ \text{mm}.$

3. The cathode ray tube of claim 1, wherein when the entire length of the cathode ray tube is indicated by C, C satisfies the following condition:

$350\ \text{mm} \leqq C \leqq 365\ \text{mm}.$

4. The cathode ray tube of claim 1, wherein when the length of a graphite layer formed at the neck is indicated by D, D satisfies the following condition:

$10\ \text{mm} < D < 23\ \text{mm}.$

5. The cathode ray tube of claim 1, wherein when the length of a graphite layer formed at the neck is indicated by D, D satisfies the following condition:

$16\ \text{mm} < D < 30\ \text{mm}.$

6. The cathode ray tube of claim 1, wherein when the length of a graphite layer formed at the neck is indicated by D, D satisfies the following condition:

$23\ \text{mm} < D < 37\ \text{mm}.$

7. The cathode ray tube of claim 1, wherein when the length of the electron gun mounted within the neck is indicated by E, E satisfies the following condition:

$60\ \text{mm} \leqq E \leqq 64\ \text{mm}.$

8. The cathode ray tube of claim 4, wherein when the length of a shield cup partially placed within the area of the graphite layer is indicated by F, F satisfies the following condition:

$6\ \text{mm} \leqq F \leqq 10\ \text{mm}.$

9. The cathode ray tube of claim 5, wherein when the length of a shield cup partially placed within the area of the graphite layer is indicated by F, F satisfies the following condition:

$6\ \text{mm} \leqq F \leqq 10\ \text{mm}.$

10. The cathode ray tube of claim 6, wherein when the length of a shield cup partially placed within the area of the graphite layer is indicated by F, F satisfies the following condition:

$$6\ \text{mm} \leqq F \leqq 10\ \text{mm}.$$

11. An image display device comprising:

a case;

a cathode ray tube partially placed within the case; and a stand, wherein the cathode ray tubes includes a panel with an inner phosphor screen, a funnel connected to the panel with a cone portion having a deflection unit mounted on an outer circumference thereof, and a neck connected to the funnel having an electron gun mounted therein, wherein when the interface between the cone portion and the neck is called a neck seal line, the portion of the electron gun sealed to the neck is called a gun sealing portion, the distance between an outer surface of the panel and the neck seal line is indicated by A and the distance between the neck seal line and the gun sealing portion by B, A and B satisfy the following conditions:

$$0.31 < B/A < 0.38, \text{ and}$$

$$79\ \text{mm} < B < 95\ \text{mm}.$$

12. The image display device of claim 11, wherein A satisfies the following condition:

$$253\ \text{mm} \leqq A \leqq 260\ \text{mm}.$$

13. The image display device of claim 11, wherein when the entire length of the cathode ray tube is indicated by C, C satisfies the following condition:

$$350\ \text{mm} \leqq C \leqq 365\ \text{mm}.$$

14. The image display device of claim 11, wherein when the length of a graphite layer formed at the neck is indicated by D, D satisfies the following condition:

$$10\ \text{mm} < D < 23\ \text{mm}.$$

15. The image display device of claim 11, wherein when the length of a graphite layer formed at the neck is indicated by D, D satisfies the following condition:

$$16\ \text{mm} < D < 30\ \text{mm}.$$

16. The image display device of claim 11, wherein when the length of a graphite layer formed at the neck is indicated by D, D satisfies the following condition:

$$23\ \text{mm} < D < 37\ \text{mm}.$$

17. The image display device of claim 11, wherein when the length of the electron gun mounted within the neck is indicated by E, E satisfies the following condition:

$$60\ \text{mm} \leqq E \leqq 64\ \text{mm}.$$

18. The image display device of claim 14, wherein when the length of a shield cup partially placed within the area of the graphite layer is indicated by F, F satisfies the following condition:

$$6\ \text{mm} \leqq F \leqq 10\ \text{mm}.$$

19. The image display device of claim 15, wherein when the length of a shield cup partially placed within the area of the graphite layer is indicated by F, F satisfies the following condition:

$$6\ \text{mm} \leqq F \leqq 10\ \text{mm}.$$

20. The image display device of claim 16, wherein when the length of a shield cup partially placed within the area of the graphite layer is indicated by F, F satisfies the following condition:

$$6\ \text{mm} \leqq F \leqq 110\ \text{mm}.$$

* * * * *

UNITED STATES PATENT AND TRADEMARK OFFICE

CERTIFICATE OF CORRECTION

PATENT NO. : 7,355,332 B2
APPLICATION NO. : 11/152981
DATED : April 8, 2008
INVENTOR(S) : Kue-Hong Lee It is certified that error appears in the above-identified patent and that said Letters Patent is hereby corrected as shown below:

In the Claims

| | |
|---|---|
| Column 7, line 9, Claim 11 | Delete "tubes",<br>Insert --tube-- |
| Column 8, line 36, Claim 20 | Delete "110",<br>Insert --10-- |

Signed and Sealed this

Ninth Day of September, 2008

JON W. DUDAS
*Director of the United States Patent and Trademark Office*